US006234301B1

(12) United States Patent
von Wyl et al.

(10) Patent No.: US 6,234,301 B1
(45) Date of Patent: May 22, 2001

(54) STRAND GUIDE, SPECIALLY FOR A SLAB CONTINUOUS CASTING INSTALLATION

(75) Inventors: Horst von Wyl, Duisburg; Ingo Schubert, Krefeld; Christoph Bunsen, Hilden; Ulrich Horbach, Neuss; Hans Siemer, Essen, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/355,427

(22) PCT Filed: Jan. 21, 1998

(86) PCT No.: PCT/DE98/00223

§ 371 Date: Aug. 27, 1999

§ 102(e) Date: Aug. 27, 1999

(87) PCT Pub. No.: WO98/32558

PCT Pub. Date: Jul. 30, 1998

(30) Foreign Application Priority Data

Jan. 27, 1997 (DE) ..... 197 03 811

(51) Int. Cl.[7] ..... B65G 15/14

(52) U.S. Cl. ..... 198/604; 198/782; 198/836.3

(58) Field of Search ..... 198/836.1, 836.3, 198/837, 604, 782, 860.1

(56) References Cited

U.S. PATENT DOCUMENTS 3,527,336 * 9/1970 Johnston ..... 198/836.3
5,918,653 * 7/1999 Knerr ..... 198/782

FOREIGN PATENT DOCUMENTS

117404 * 4/1986 (EP) .
222732 * 4/1990 (EP) .

* cited by examiner

*Primary Examiner*—James R. Bidwell
(74) *Attorney, Agent, or Firm*—Cohen, Pontani, Lieberman & Pavane

(57) ABSTRACT

A strand guide, in particular for a continuous slab-casting plant for steel, with supporting segments in which frames are arranged that have rows of guide rollers and driving rollers arranged opposite one another, wherein the frames are held opposite one another by tie rods. Two guide members are provided at one end of a frame at equal distance from the center axis. The guide members are fastened to at least one fixed point via holding elements and are arranged conically at an opening angle relative to one another.

13 Claims, 4 Drawing Sheets

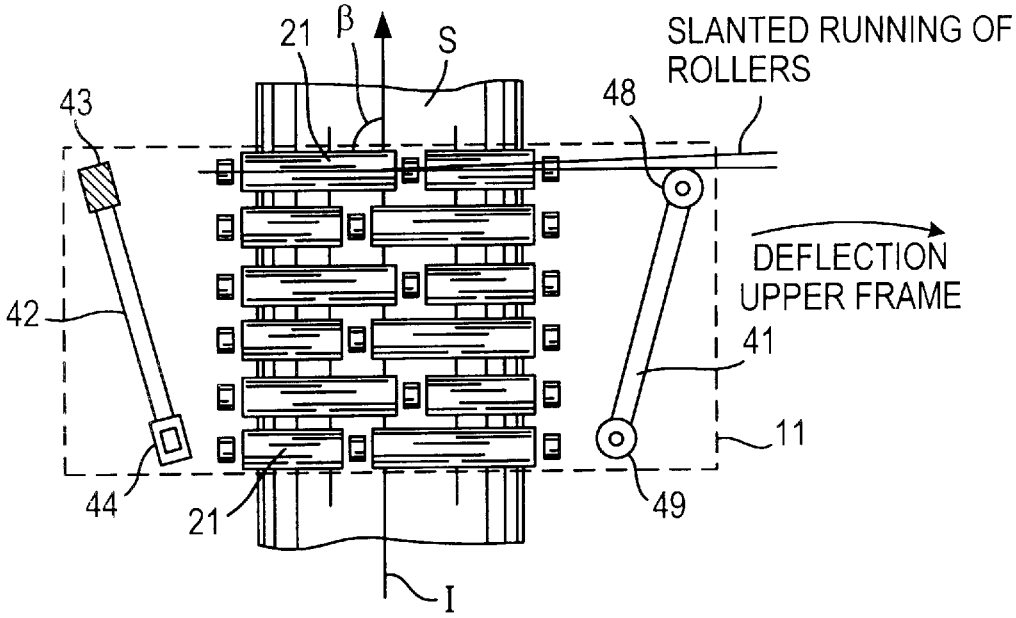
FIG. 3.1
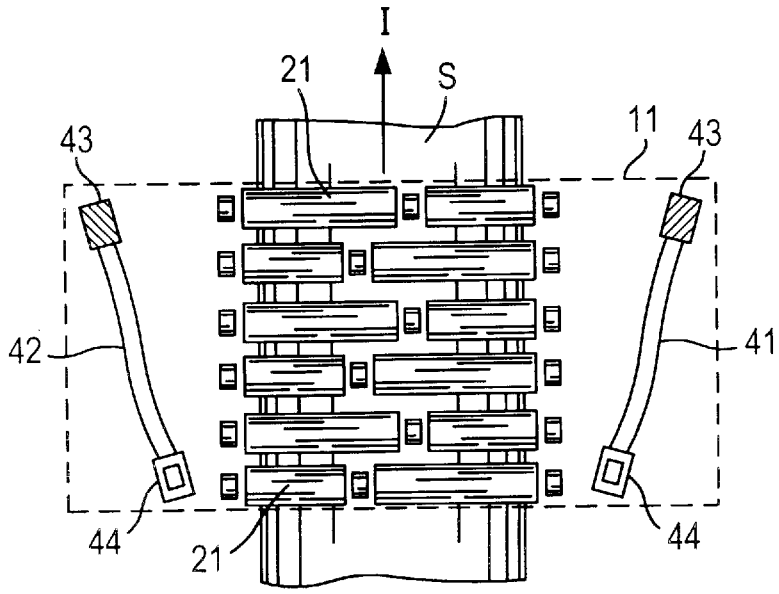
FIG. 3.2

STRAND GUIDE, SPECIALLY FOR A SLAB CONTINUOUS CASTING INSTALLATION

BACKGROUND OF THE INVENTION

1. Field of the Invention

The invention is directed to a strand guide, in particular for a continuous slab-casting plant for steel, with supporting segments in which are arranged frames which have rows of guide rollers and driving rollers arranged opposite one another, wherein the frames are held opposite one another by tie rods.

2. Discussion of the Prior Art

A strand guide having supporting segments carrying a plurality of rollers is known from EP European referece 0 222 732 B1. The supporting segments are fastened to a one-piece longitudinal beam, especially a curved longitudinal beam. In order to prevent roller offset between two adjacent supporting segments, carrying plates and setting pins are provided. These carrying plates and setting pins are manufactured and arranged in such a way that roller offset is prevented also during assembly and disassembly. The roller segments themselves are fixedly mounted as a closed unit.

EP European refererce 0 117 404 B1 discloses a supporting guide in a continuous casting plant for steel with two oppositely located rows of guide rollers and driving rollers, portions of which are mounted at crossbeams. The top crossbeam is held by tie bars at supports of a fixed crossbeam arranged at a base frame. No additional guidance of the fixed crossbeam (lower frame) or top crossbeam (upper frame) is provided.

During operation of a strand guide of the abovementioned type, especially in slab casting plants and continuous casting plants for steel, shearing forces occur in the upper frame, essentially due to slanted running of the rollers. Not only does this result in increased wear on rollers and roller bearings, but the transmission of high shearing forces between the upper frame and lower frame requires side frames dimensioned in a correspondingly robust manner. Further, shaping errors can occur in the strand, especially slanting of the narrow sides due to the shearing forces.

SUMMARY OF THE INVENTION

The aim of the invention is to prevent the abovementioned disadvantages and to provide a strand guide, especially for a continuous slab-casting plant, which ensures automatic centering of at least one of the oppositely located frames of the individual supporting segments relative to the strand so as to be free of play in a simply designed construction.

According to the invention, guide members are provided which are arranged conically at an opening angle relative to one another and fastened at one end to the end of a frame via holding elements and at the other end to at least one fixed point.

In a bow-type continuous casting plant, the guide members are fastened to the upper frame, while the other end is fastened to the curved longitudinal beam of the continuous casting plant or, preferably, to the lower frame. The opening angle of the two guide members can be as much as 60°. The conical opening is preferably arranged in the strand guiding direction. For this purpose, knee-shaped extensions are provided at the upper frame.

The connection between the guide member and the holder at the frame is constructed as a joint or as holders which are fixed with respect to rotation relative to it.

Particularly when using the holder which is fixed with respect to relative rotation, the guide members that are used are constructed as bars and are formed of a material withstanding tensile and compressive forces and lateral deformation. Bundles of barshaped or strip-shaped material having a rectangular, polygonal or round cross section are used for this purpose. Intermediate layers are provided in order to prevent fretting corrosion or frictional corrosion between the individual guide members.

Due to the construction according to the invention, no shearing forces occur between the upper frame and the lower frame, so that a side frame may be dispensed with.

The elimination of shearing forces improves the operational dependability of the supporting segments because jamming cannot occur in spite of extensive freedom of movement of the guided frame.

Since bulky, rigid side frames are not required, side access to the individual segments is clearly improved.

Further, manufacturing costs are reduced in that uneconomical transmission elements and linear guide elements are dispensed with.

The construction according to the invention also facilitates the realization of dynamic adaptation of gate or feed opening widths during the casting operation. This is especially advantageous in soft reduction, as it is called. Through the use of guide members, the freedom of movement of the upper frame relative to the lower frame in a bow-type continuous casting plant is substantially increased, particularly with respect to the degrees of freedom of tilting about the horizontal axes.

An example of the invention is shown in the accompanying drawing.

BRIEF DESCRIPTION OF THE DRAWING

FIG. 3.1 and 3.2 show a top view of the upper frame and;

DETAILED DESCRIPTION OF THE PREFERRED EMBODIMENTS

Figure 1:
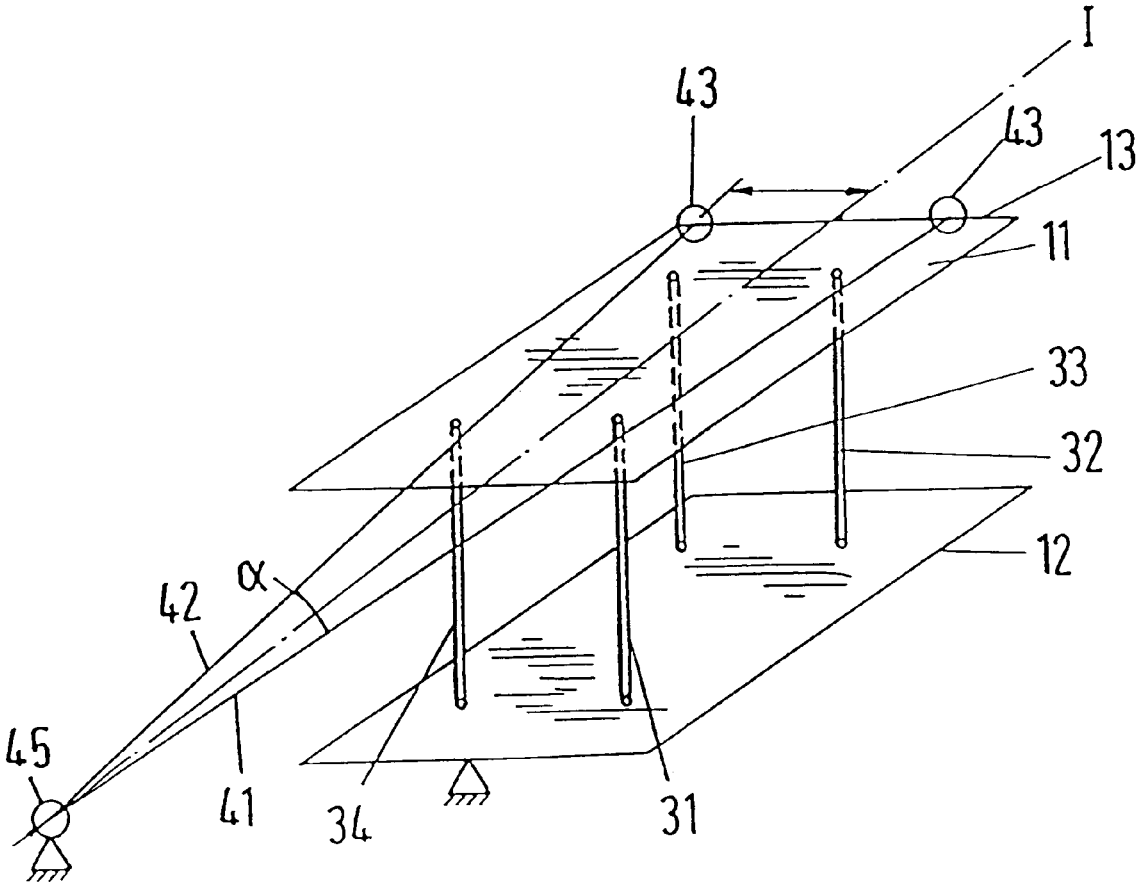
FIG. 1 shows a schematic view of the strand guide.

The schematic view in FIG. 1 shows two frames which are arranged in a parallel manner, namely, an upper frame 11 and a lower frame 12 which are connected at a distance from one another by tie rods 31 to 34. Guide members 41, 42 are fastened at the same distance a to the end 13 of the frame 11. The guide members 41, 42 are arranged conically relative to one another at an angle $\alpha$ of 10° to 60° and are joined at a holding point 45.

The upper frame 11 moves in a plane at a distance corresponding to the length of the tie rods 31–34 relative to the fixed lower frame 12. The frame 11 is guided by the guide members 41, 42 in the direction of its longitudinal extension as well as with respect to its allocation to the center axis I.

Figure 2:
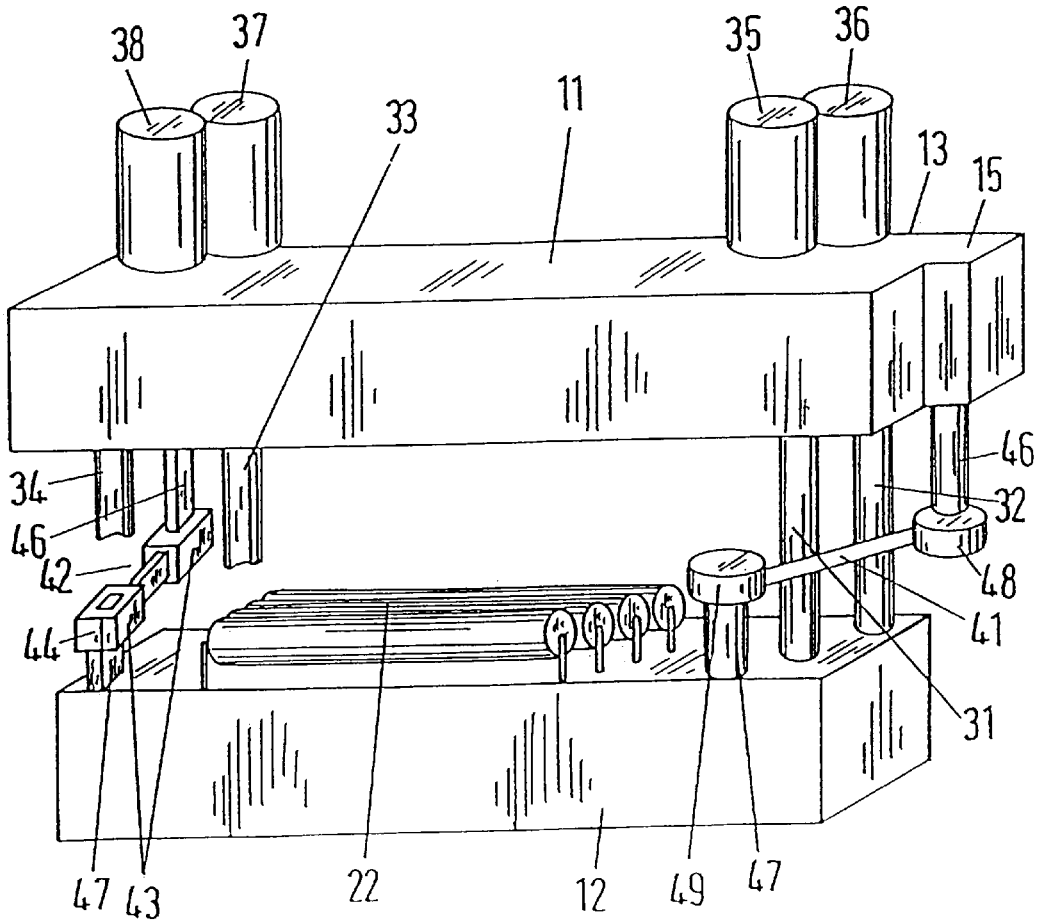
FIG. 2 shows a segment with upper frame and lower frame.

FIG. 2 shows a supporting segment of a continuous casting plant with an upper frame 11 and a lower frame 12 in a bow-type continuous casting plant. In the present Figure, only the rolls 22 of the lower frame 12 are shown. The frames 11 and 12 are connected with one another by the tie rods 31 to 34, each of which has a hydraulic device 35 to 38.

The upper frame 11 has, at its end 13, knee-shaped or step-shaped extensions 15 at both sides. Pins 46 provided at the extension 15 have a joint 48 shown on the right-hand side of the drawing and a holding element 43 shown on the left-hand side serving as connection to the guide members 41, 42.

The guide members 41, 42 are fastened to the lower frame 12 at the other end respectively by a holding element 44 and a joint 49 with pin 47.

FIGS. 3.1 and 3.2 show a top view of the rollers 21 of the upper frame 11 (in dashed lines) with the strand S guided beneath them.

The guide members 41, 42 arranged at either side of the supporting segment have holding elements 43, 44 or joints 48, 49 at their head.

FIG. 3.1 shows a situation in which the upper frame is not correctly aligned with the strand, but rather is at an angle β relative to it, resulting in slanted roller running. During operation, the upper frame in the present example is deflected to the right.

In FIG. 3.2, guide members are used which are fastened to the upper frame and lower frame via holders 43, 44 which are fixed with respect to rotation relative thereto. Due to the deflection of the upper frame toward the right in the present example, the upper frame with its continuous casting rollers is oriented in such a way as a result of the conical arrangement of the guide members 41, 42 that it is centered on the strand S.

Figure 4A:
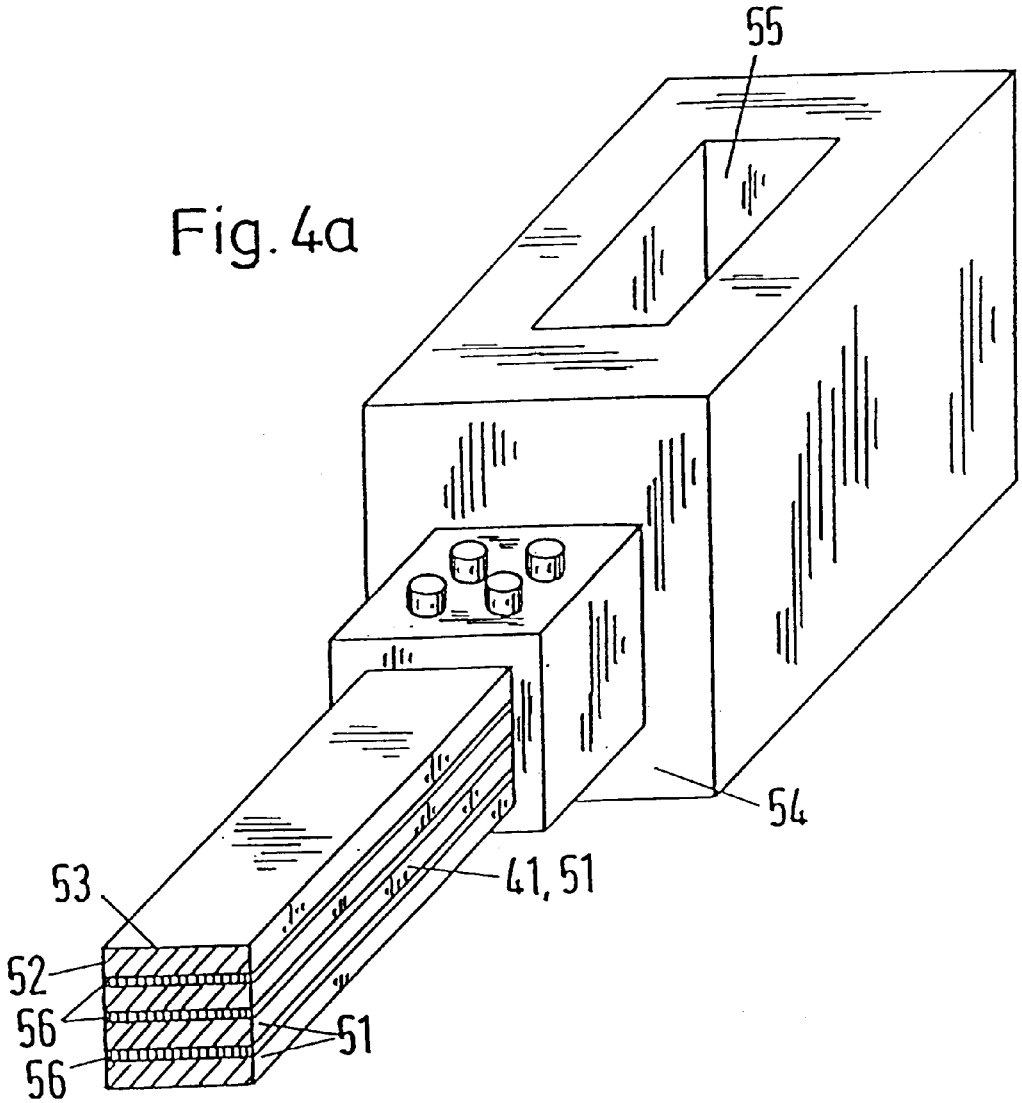
FIG. 4 shows a detail of a guide member with holding element.

FIG. 4*a* shows a guide member 41 which is constructed as a strip 51. The individual strips are arranged in such a way that at least a narrow side 52 is inclined toward the strand and the broad sides 53 are connected with one another via intermediate layers 56.

A holding head 54 is fastened to the guide member 41 in a frictional engagement. The holding head 54 has an opening 55 which corresponds with one of the pins 46, 47 (see FIG. 3) of the upper and lower frame.

Figure 4B:
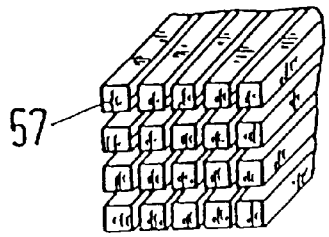
Figure 4C:
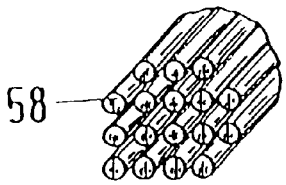

The use of square or rectangular rods 57 or round rods 58 is shown schematically in FIGS. 4*b* and 4*c*. Other cross-sectional shapes, for example, hexagons, are not mentioned in detail. It is desirable to form the rods of spring steel.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

What is claimed is:

1. A strand guide, comprising:

supporting segments having frames in which rows of guide rollers and driving rollers are arranged opposite one another;

tie rods arranged to hold the frames opposite one another;

two guide members provided at one end of one of the frames at an equal distance from a center axis of the frame; and holding elements that fasten the guide members to at least one fixed point, the guide members being arranged conically at an opening angle relative to one another.

2. A strand guide according to claim 1, wherein the frames include an upper frame and a lower frame, the upper frame has, at least in an end region, extensions perpendicular to a strand guide direction, the guide members being fastened to the extensions via the holding elements.

3. A strand guide according to claim 2, and further comprising pins provided at the extensions, the pins having pin heads, the guide members having one end fastened to the upper frame at the pin heads by the holding elements, the guide members having another end fastened to an end of the lower frame by the holding elements.

4. A strand guide according to claim 3, wherein the holding elements are constructed as joints.

5. A strand guide according to claim 3, wherein the holding elements are constructed as positive-locking holders which are fixed with respect to rotation.

6. A strand guide according to claim 1, wherein the holding elements are arranged at both ends of the guide members, the guide members being constructed as rods formed of a material withstanding tensile and compressive forces and lateral deformation.

7. A strand guide according to claim 6, wherein the guide members are formed of spring steel.

8. A strand guide according to claim 6, wherein the guide members are formed of bundles of strips which are rectangular in cross section.

9. A strand guide according to claim 8, wherein the rectangular strips are inclined toward the frames by their narrow sides and are arranged so as to contact one another by their broad sides.

10. A strand guide according to claim 6, wherein the rods have one of a rectangular, round and polygonal cross-section.

11. A strand guide according to claim 9, wherein intermediate layers are provided between the strips, the intermediate layers being formed of a material which prevents friction between the strips.

12. A strand guide according to claim 8, and further comprising heads connected with the bundles of strips, the heads being arranged at both ends of the guide members in a frictional engagement.

13. A strand guide according to claim 1, wherein the opening angle is 10° to 60°.

* * * * *